United States Patent [19]

Kohri et al.

[11] Patent Number: 4,968,577

[45] Date of Patent: Nov. 6, 1990

[54] WRINKLE CONFIGURED ELECTROPHOTOGRAPHIC CAPSULE TONER PARTICLES

[75] Inventors: Toshitaro Kohri, Higashiosaka; Junji Machida, Toyonaka; Masahiro Anno, Sakai, all of Japan

[73] Assignee: Minolta Camera Kabushiki Kaisha, Osaka, Japan

[21] Appl. No.: 395,185

[22] Filed: Aug. 18, 1989

Related U.S. Application Data

[63] Continuation of Ser. No. 104,038, Oct. 2, 1987, abandoned.

[30] Foreign Application Priority Data

Oct. 3, 1986 [JP] Japan ..... 61-236611
Aug. 7, 1987 [JP] Japan ..... 62-198373

[51] Int. Cl.[5] ..... G03G 9/16; G03G 11/00

[52] U.S. Cl. ..... 430/111; 430/138; 430/137; 428/402.21; 525/934; 524/901; 526/934; 526/89

[58] Field of Search ..... 430/137, 111, 138; 428/402.21; 526/934, 89

[56] References Cited

U.S. PATENT DOCUMENTS

| | | | |
|---|---|---|---|
| 3,234,017 | 2/1986 | Heyl et al. | 430/97 |
| 3,392,139 | 7/1968 | Dingman | 430/111 X |
| 3,938,992 | 2/1976 | Jadwin et al. | 430/120 |
| 3,970,571 | 7/1976 | Olson | 430/110 X |
| 4,016,099 | 5/1977 | Wellman et al. | 430/137 |
| 4,672,017 | 6/1987 | Kamezaki | 430/122 |
| 4,727,011 | 2/1988 | Mahabadi et al. | 430/138 |

*Primary Examiner*—J. David Welsh
*Attorney, Agent, or Firm*—Burns, Doane, Swecker & Mathis

[57] ABSTRACT

The present invention provides a capsule toner having many wrinkles or hollows and upheavals and containing liquid in a shell, which is useful for toner for pressure fixation.

12 Claims, 5 Drawing Sheets

WRINKLE CONFIGURED ELECTROPHOTOGRAPHIC CAPSULE TONER PARTICLES

This application is a continuation of application Ser. No. 07/104,038, filed Oct. 2, 1987, now abandoned.

BACKGROUND OF THE INVENTION

A latent electrostatic image is developed in a manner wherein, on such an image formed on a photosensitive member by one of various ways a toner which has been charged by one of various methods, for example, by friction with a carrier or a sleeve, is made to be statically adsorbed, and then the toner image is transferred onto a transfer sheet and fixed thereto for the fixation of the developed image.

The methods for fixation of developed images can be broadly divided into the following methods: so-called heat fixation method wherein toner is melted by application of heat and fusion-attached to paper; so-called pressure fixation method wherein toner particles are deformed by application of pressure and pressure-attached to paper; and so-called solvent fixation method wherein toner is melted by application of solvent or the like and melt attached to paper. The solvent fixation method, however, is not suited to practice because of the pollutive nature of the solvent.

At present the heat fixation method is in major use for the fixation. Copying machines based on the heat fixation method have made a remarkable progress through various improvements. But the fixing device is heated by an electric heater, and a copying machine requires time for heating up the fixing device before it is ready for the copying after switching it on. It is 10–15 seconds with a quick model and 1–5 minutes ordinarily that it takes for the preliminary heating before the operation. Furthermore, when a fixing device loses heat and its temperature lowers, it requires reheating up to a prescribed temperature. Most of the copying machines based on the heat fixation method, therefore, exceeds 1 KW in power consumption, a major part of the power being expended for heating the fixation device.

The pressure fixation method is advantageous, having no need of the preliminary heating which was mentioned above and not wasting electric energy for the heating. But the conventional pressure fixation method also involves defects in that the toner is fixed at such a high pressure that the pressure causes the transfer sheet to curl up and in that the equipment costs high for this mechanism. Furthermore, lower firmness of fixation, compared with the heat fixation method, constitutes another problem. It has been awaited, therefore, for a capsule toner to be commercially introduced, one improved in fixation property and capable of fixation by application of a low pressure (80–400 kg/cm$^2$).

For the production of capsule toners, it has already been proposed to introduce, for example, a spray-dry method, interfacial polymerization method, coacervation method, phase-separation method, and in-situ polymerization method (references: U.S. Pat. Nos. 3,338,991, 3,326,848, 3,502,582 etc.).

A particle of capsule toner consists of a shell and a filling therein, said shell consisting mainly of a resin which is designed to be broken by pressure and said filling consisting mainly of coloring materials, such as carbon black and magnetic powder, and binders, such as a resin for fixation and a wax.

A capsule toner is known to be suited to a pressure fixation method primarily for the reasons that high pressure is not required for the fixation and that good fixation results, but the capsule toners known so far have not been quite satisfactory with respect to their properties essential to toner.

An example is a capsule toner of the so-called solid filling type, made public in U.S. Pat. No. 4,259,426, whose filling consists mainly of a solid wax. A capsule toner of the solid filling type is easy to be fixed without requiring high pressure for the fixation, but it produces picture images with unsatisfactory results, the images showing a characteristic glaze. Moreover, the firmness of the fixation is generally inadequate. For example, bending, folding, or scratching of a picture image causes it to have a smear by stretching or to come off the substrate, the problems incidental to pressure fixation remaining as heretofore.

U.S. Pat. No. 4,442,194 specifies a capsule toner of the so-called liquid filling type, which features a filling consisting of a solvent, a resin for fixation dissolved in said solvent, and a pigment as a colorant. A capsule toner of this type is shown in FIG. 5.

When a capsule toner of the liquid filling type is used, the shell (3) is broken by pressure, allowing the resin for fixation in the form of solution therein to spill out and cover the pigment (2) as the resin is fixed to a substrate. Generally a capsule toner of the liquid filling type produces a picture image with satisfactory results in quality, the picture image showing no glaze as would be seen in one of a solid filling type capsule toner.

Various problems remain to be solved, however. If it is attempted to lower the pressure for the fixation, inadequate firmness of the fixation arises as a problem. Even when the pressure is sufficient to break the toner shells, the capsule toner may be driven into the interspace between fibres of the transfer sheet if its surface is coarse, so there is a problem that the toner left out of fixation attaches to and smears the paper. Other problems include inadequate cleaning and filming on the surface of a photosensitive member.

Generally, a capsule toner containing a liquid in the shell is obtained more or less as a true globe in shape, having a relatively small surface area. This small surface area of the toner and inadequate catch between the toner and the carrier raise a problem of low charge even when a toner has been charged by friction with a carrier and one of unsatisfactory rising characteristic in charging that tends to cause the toner to fly about.

Another problem poses itself when a spherical toner is subjected to a running test in a PPC copying machine using a blade cleaning method. The toner is not completely cleaned away from the photosensitive member but part of it attaches to the photosensitive member by fusion as it clears the blade cleaner. Charging takes place on this toner which has attached by fusion, and is developed in the following copying procedure, and eventually produces black streaks in the picture image.

SUMMARY OF THE INVENTION

Any of a conventional capsule toner for pressure fixation has a problem as mentioned above. The present invention has for its object to provide a capsule toner which is free from the problems in the foregoing description, being satisfactory in initial rising characteristic in charging, in fixation property shown when a low pressure is applied, in cleaning property, and regarding filming on the surface of a photosensitive member. Accordingly, this invention provides a capsule toner which consists of a shell of a chargeable resin and a filling therein, said filling consisting at least of a high boiling point solvent, a resin for fixation dissolved or dispersed in said solvent, and a colorant, said shell having many dents around the spherical surface, as shown in FIGS. 1, 3 and 4.

BRIEF DESCRIPTION OF THE DRAWING

These and other objects and feature of the present invention will become apparent from the following description taken in conjunction with the preferred embodiment thereof with reference to the accompanying drawings, in which.

DETAILED DESCRIPTION OF THE INVENTION

The present invention provides a capsule toner which essentially consists of a shell of a chargeable resin and a filling therein, said filling consisting at least of a high boiling point solvent, a resin for fixation dissolved or dispersed in said solvent, and a colorant: in said toner, the number average particle sizes ranging 5–17 μm in the distribution of the particles, the particles with sizes of less than 3 μm having a proportion of less than 10% in number and those with sizes of more than 20 μm having a proportion of less than 5% in number, and the shape factor (SFI) represented by the formula:

$$SF1 = \frac{(\text{maximum length})^2}{\text{area}} \times \frac{\pi}{4} \times 100$$

(wherein the maximum length is the largest distance between any two points on the periphery in the projection chart of a particle, and the area represents the area of the projection of a particle).

Figure 1:
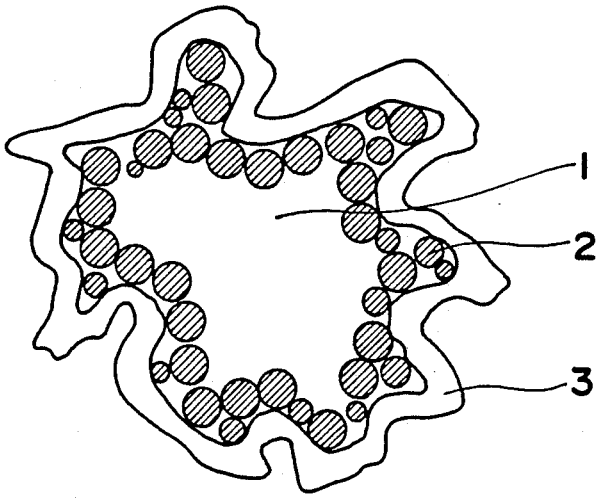
FIG. 1 schematically illustrates a cross-section of a particle of a capsule toner embodying the present invention.
Figure 6:
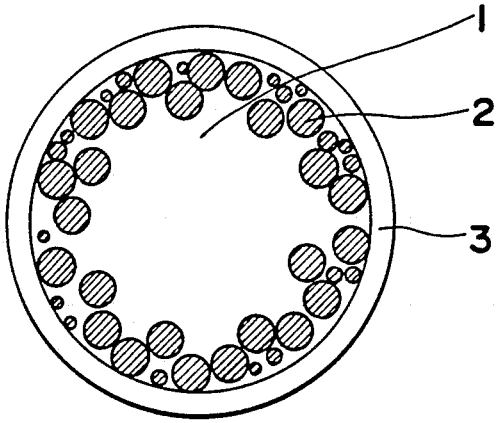
FIG. 6 schematically illustrates a cross section of a conventional spherical capsule toner.

FIG. 1 illustrates in schematic cross-sectional representation a particle of capsule toner provided by the present invention (hereinafter referred to as "a capsule toner according to the invention"). A capsule toner according to the invention has many wrinkles or hollows and upheavals. It is dented from part to part in shape rather than have a plurality of protrusions on the surface. It consists of a shell (3) and a filling therein: said filling consists of a solvent and a resin for fixation (1) which is in solution in said solvent and a pigment (2) as a colorant; and said shell consists of a resin which is stable to said solvent without being dissolved therein or without swelling, and the shell may be formed in the form of a capsule by a suitable polymerization, especially interfacial polymerization.

The distorted shape of a capsule toner according to the invention can be represented by a shape factor SF1 which is in use as a factor representing the shape of a powder particle and by a formula $$SF1 = \frac{(\text{maximum length})^2}{\text{area}} \times \frac{\pi}{4} \times 100$$

In this formula, the maximum length means the largest distance between any two points on the periphery in the projection chart (plan) of a particle, and the area is represented by the area of the projection of a particle.

The shape factor SF1 represent a distortion that arises out of the difference between the major axis and the minor axis of a toner and assumes SF1=100 if the particle is perfectly globular.

A capsule toner according to the invention has an SF1 in the range 120–180, preferably in the range 130–180. If SF1 is smaller than 120, the chargeability and cleaning property are unsatisfactory, whereas, if SF1 is larger than 180, the formation of the capsule toner is difficult.

The shape factors in the present invention are values determined by an image analyzer (Luzex 5000, made by Japan Regulator Co.).

A capsule toner according to the invention is produced, for example, by one of the following methods:

(a) A monomer is polymerized in a solvent to form a polymer resin solution which is used as a resin for fixation, and by dispersing a pigment therein a filling material is formed. Then a shell is formed to encapsulate the filling material thus obtained.

(b) An emulsion is formed with a high boiling point solvent, a monomer, a polymerization initiator, and a colorant, such as pigment, as ingredients. A shell is formed to encapsulate the filling as a resin for fixation is synthesized in the manner of in-situ polymerization.

(c) A filling is prepared by dissolving in a solvent a resin which has preliminarily been prepared by polymerization as a resin for fixation, and by dispersing a pigment therein. Then a shell is formed to encapsulate the filling.

The application of both methods of in-situ polymerization and interfacial polymerization in combination brings about particularly good results in the shape of the capsule toner.

The mechanisms of the formation of a capsule toner having a wrinkle according to the present invention are considered to be as follows:

(1) The application of both methods of in-situ polymerization and interfacial polymerization forms both shells and resins for fixation. If the polymerization velocity of the shell is greater than that of the resin for fixation, the shells are formed first and the polymerization of the resin for fixation takes place next. Then the filling in the shells shrinks as the monomer turns into a polymer through the reaction, and the shells contract proportionately and assume a wrinkle.

(2) The in-situ polymerization mentioned under (b) for the formation of a capsule toner in some cases is practiced, besides a monomer, with a polyol etc. as an ingredient. Then a cross-linking reaction occurs between the outward portion of the filling and the shell membrane, causing the shell to shrink into a wrinkled shape.

(3) In the practice of the method mentioned under (c), a resin for fixation is dissolved in a solvent, and additives, such as a pigment, are incorporated into the solution, and then the solution thus prepared with preliminary mixing is encapsulated in shells. To encapsulate the solution, the shell is formed first so that the organic solvent with a relatively low boiling point, used in the filling material, is vaporized through fine holes in the shell, and, as a result, the shell shrinks and assumes the shape of a dried apricot. The same reasoning applies to the method mentioned under (a).

Besides the above reasons, the characteristic shape of the shell is attributed to the condition of stirring when a suspension is formed, the condition of forming the shell for encapsulation, the boiling point and the quantity of the solvent used in a filling material, and the kind and the quantity of the suspension emulsifier.

The wrinkled shape that a capsule toner assumes helps to improve the rising characteristic in charging and to prevent fogging and blacks streaks which are attributed to inadequate cleaning in brushing resistance test.

There are many cases where a capsule toner is mixed with smaller size toner particles. This is because, unlike conventional toners produced by pulverization, fine particles produced through suspension remain without being encapsulated in shells and solidify as small size toner particles. These small size toner particles are considered to cause deterioration of the fixation property and the cleaning property. In a measurement of the particle size distribution of toner, the relative weight distribution by particle sizes, for which the most generalized Coulter counter measurement and indications were studied, fails to show corresponding relations with various properties mentioned above. This is because, even if the small size toner particles, which practically most influence various properties as mentioned above, are contained in a large number, they do not assume any conspicuous proportion in the relative weight distribution by particle sizes.

This will now be considered by studying the number distribution by particle sizes in the manner of comparison, which can be measured and indicated by Coulter counter as well as the weight distribution.

Figure 2:
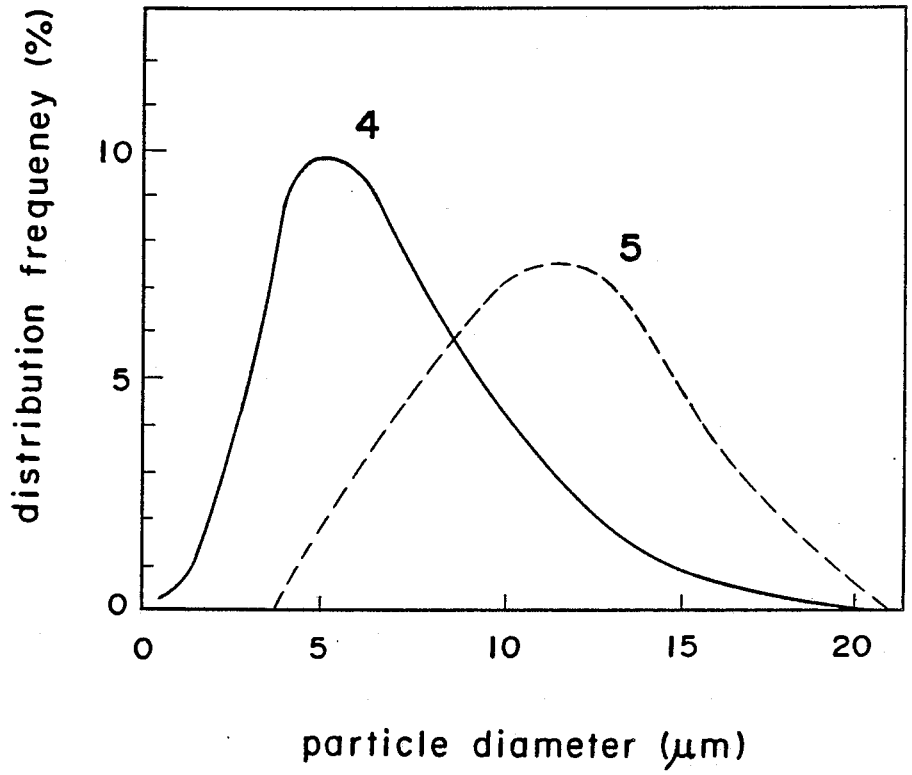
FIG. 2 shows an example of the distribution curve of a toner determined by a Coulter counter.

FIG. 2 shows a distribution curve based on the data determined by Coulter counter. The solid line (4) shows a number distribution by particle sizes, and the broken line (5) a relative weight distribution by particle sizes. As shown by these two curves, the measurement of the same toner sample with the same measuring instrument results in different positions of the curves by particle sizes (average particle sizes) and different shapes of the curves. For example, given spherical particles including ten 2 μm particles and ten 20 μm particles in every 100 particles, (i) the measurement of the number distribution by particle sizes provides the same value of distribution, i.e., 2 μm particles account for 10% and 20 μm particles account for 10%, but (ii) in the measurement of the relative weight particle sizes, 2 μm particles are converted to weight $$V(2\ \mu m) = \frac{4}{3}\pi \times 1^3 = \frac{4}{3}\pi \text{ and}$$

20 μm particles are converted to weight $$V(20\ \mu m) = \frac{4}{3}\pi \times 10^3 = \frac{4000}{3}\pi$$

so that a weight ratio $$V(2\ \mu m):V(20\ \mu m) = 1:1000$$

is obtained.

As is clear from the above, 20 μm particles are 1,000 times as large in number as 2 μm particles datawise, although the number of the particles is the same between the two. In other words, small size particles are measured in the relative weight distribution by particle sizes, but they are disregarded in the data processing, hence no value.

It was discovered in the present invention that the small size particles of less than 3 μm, which are difficult to determine in the relative weight distribution by particle sizes, have a large influence upon various properties of capsule toners, the quality of the picture obtained, and properties in running test. For example, the pressure fixation property and the cleaning property are improved and fogging decreases in running test by reducing the particles of less than 3 μm to less than 10% in number. The filming resistance is improved and fogging in brushing resistance decreases by reducing the particles of more than 20 μm to less than 5% in number.

There is now explained how to prepare a capsule toner by the method (a) according to the present invention.

The monomers capable of being polymerized in a resin for fixation according to the present invention include both monofunctional monomers and multifunctional monomers.

The monofunctional monomers are: styrene monomers such as, for example, styrene, alpha-methylstyrene, o-methylstyrene, m-methylstyrene, p-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene and p-phenylstyrene; acrylic monomers such as methylacrylate, ethylacrylate, n-propylacrylate, iso-propylacrylate, n-butylacrylate, iso-butylacrylate, tert-butylacrylate, n-amylacrylate, n-hexylacrylate, 2-ethylhexylacrylate, n-octylacrylate, n-nonylacrylate, cyclohexylacrylate, benzylacrylate, dimethylphosphate ethylacrylate, diethylphosphate ethylacrylate, dibutylphosphate ethylacrylate, and 2-benzoiloxy ethylacrylate; methacrylate monomers such as methyl methacrylate, ethyl methacrylate, n-propyl methacrylate, iso-propyl methacrylate, n-butylmethacrylate, iso-butyl methacrylate, tert-butyl methacrylate, n-amyl methacrylate, n-hexylmethacrylate, 2-ethylhexyl methacrylate, n-octyl methacrylate, n-nonyl methacrylate, diethylphosphate ethylmethacrylate, and dibutylphosphate ethylmethacrylate; methylene aliphatic monocarboxylic acid esters; and vinyl monomers including vinyl esters such as, for example, vinyl acetate, vinyl propionate, vinyl benzoate, vinyl butyrate, and vinyl formate, vinyl ethers such as vinyl methyl ether, vinyl ethyl ether, and vinyl isobutyl ether, and vinyl ketones such as vinyl methyl ketone, vinyl hexyl ketone, and methyl isopropylketone.

The multifunctional monomers are, for example: diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxy diethoxy)phenyl) propane, trimethylol propane triacrylate, tetramethylol methane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-(methacryloxy.diethoxy)phenyl) propane, 2,2'-bis(4-(methacryloxy.polyethoxy)phenyl) propane, trimethylol propane trimethacrylate, tetramethylol methane trimethacrylate, divinyl benzene, divinyl naphthalene, and divinyl ether.

The monofunctional monomers can be used each singly or two or more of them in combination, or a monofunctional monomer and a multifunctional monomer in combination.

A monomer is used in a proportion of 1–1,000 parts by weight, preferably in a proportion of 50–800 parts by weight, and more preferably in a proportion of 100–700 parts by weight, as against 100 parts by weight of solvent. If used in a larger proportion than 1,000 parts by weight, the polymer is stiff and the firmness of fixation deteriorates. If used in a proportion of less than 1 part by weight, the binder properties deteriorate because of lack of the polymer component.

The solvent selected must not dissolve or swell the shells which are formed at a later step in the manufacturing procedure.

Solvents suitable for the use are, for example, nonane, decane, undecane, dodecane, tridecane, tetradecane aliphatic hydrocarbon such as branched isoparaffin, high boiling point solvent such as an organic polysiloxane expressed by the general formula (I)

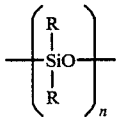

(I)

wherein R represents an alkyl group of methyl type, ethyl type, etc. or phenyl group, and n represents 3 or a higher integer, and liquid paraffin, and mixed solvent of a low boiling point polar organic solvent such as acetone, dichloromethane, methylene chloride, ethylene chloride and tetrahydrofuran. The boiling point of a high boiling point must not exceed 350° C., and is preferably 150°–350° C. If the boiling point is higher than 350° C., the vaporization of the solvent after fixation is slow. The boiling point of a low boiling point solvent should be higher than 30° C., and is preferably 30°–80° C. If the boiling point is lower than 30° C., the solvent quickly vaporizes during reaction and the viscosity increases.

A polymerization initiator used according to the invention is an oil-soluble initiator soluble in any of the above-mentioned solvents. Examples of the most suitable one for the use are a radical polymerization initiator, for instance, azo compounds such as 2,2'-azo bis-isobutylonitrile, 2,2'-azo bis-2,4 dimethyl valeronitrile, and 2,2'-azo bis-4-methoxy-2,4-dimethyl valeronitrile; and peroxide initiators such as acetyl cyclohexyl sulfonyl peroxide, diisopropyl peroxydicarbonate, decanonyl peroxide, lauroyl peroxide, stearoyl peroxide, propionyl peroxide, acetyl peroxide, t-butylperoxy-2-ethylhexanoate, benzoyl peroxide, t-butylperoxy isobutyrate, cyclohexanone peroxide, methyl ethylketone peroxide, dicumilperoxide, t-butylhydro peroxide, di-t-butylperoxide, and cumene hydroperoxide.

A radical polymerization initiator may be used in a proportion of 0.01–5 parts by weight, preferably 0.5–2 parts by weight, as against 100 parts by weight of monomer. If the use is less than 0.01 part by weight, the polymerization takes place slowly. If the use is more than 5 parts by weight, it is difficult to control the polymerization.

The radical polymerization reaction may be carried out at 50°-90° C., preferably at 60°–90° C. If the temperature is lower than 50° C., the polymerization takes place slowly. If it is higher than 90° C., the shell may become porous through vaporization of the monomer or solvent, or a low molecular weight polymer may be formed and cause offset to the roller, or aging stability may become inadequate.

It is generally sufficient to allot 4–10 hours to a radical polymerization reaction, though the time may vary depending on the polymerization reaction temperature etc. It is preferable to carry out a radical polymerization reaction in an environment lacking oxygen. Because oxygen functions as a radical scavenger and its presence runs counter to a polymerization reaction. It is therefore desirable for an aliphatic hydrocarbon solvent for the use to be free from dissolved oxygen. Dissolved oxygen can be removed by subjecting the solvent to bubbling in an inert gas, such as nitrogen or argon, for a certain length of time.

Suitable for coloring may be highly magnetic metal powders such as ferrite, magnetite, cobalt and nickel, furnace black which is a conventional black pigment, carbon black such as channel black, copper oxide, non-magnetic pigment such as compound oxides of manganese and copper and those of copper-chrome, polymer beads dyed by various dyes, various inorganic and organic pigments, another dye etc. It is effective as well at the time of the reaction, to dissolve or disperse additives in materials forming shells. The above-mentioned additives can be added before the radical polymerization reaction starts.

A colorant in the above description may be used in a proportion of 5–60 parts by weight, preferably in a proportion of 20–40 parts by weight, as against 100 parts by weight of the monomer used. If the use is less than 5 parts by weight, the shell does not form well and the strength of the shell is inadequate.

Isocyanates, and polyols, too, where necessary, may be used as materials for forming shells.

At a later step of the manufacturing procedure, an isocyanate reacts with an amine or a polyol to form a shell membrane having a urea bonding or urethane bonding.

Isocyanates useful for this purpose are, for example, xylene-1,4-diisocyanate, xylene-1,3-diisocyanate, trimethylene diisocyanate, hexamethylene diisocyanate, propylene-1,2-diisocyanate, butylene 1,2-diisocyanate, ethylidene diisocyanate, cyclohexylidene-1,2-diisocyanate, cyclohexylidene-1,4-diisocyanate, m-phenylene diisocyanate, p-phenylene diisocyanate, 2,6-tolylene diisocyanate, 2,4-tolylene diisocyanate, naphthalene-1,4-diisocynate, diphenyl methane-4,4'-diisocyanate, toluylene diisocyanate, triphenyl methane diisocyanate, polymethylene polyphenyl isocyanate, 4,4'-dimethyl diphenylmethane-2,2',5,5'-tetraisocyanate, addition product of hexamethylene diisocyanate and hexanetriole, addition product of 2,4-tolylenediisocyanate and catechol, and addition product of tolylene diiosocyanate and trimethylol propane, and addition product of xylene diisocyanate and trimethylol propane. Any of these isocyanates can be used each singly or in combination with others.

Polyols useful for the purpose are, for example, ethylene glycol, propylene glycol, 1,4-butanediol, catechol, resorcinol, hydroquinone, 1,2-dihydroxy-4-methylbenzene, 1,3-hydroxy-5-methylbenzene, 3,4-dihydroxy-1-methylbenzene, 3,5-dihydroxy-1-methylbenzene, 2,4-dihydroxy-1-ethylbenzene, 1,3-naphthalenediol, 1,5-naphthalenediol, 2,3-naphthalenediol, 2,7-naphthalenediol, o,o'-bisphenol, p,p'-bisphenol, 1,1'-bi-2-naphthol, bisphenol A, 1,3-propylene glycol, 1,4-butylene glycol, 1,5-pentanediol, 1,6-pentanediol, 1,7-pentanediol, 1,8-octenediol, glycerin and water.

Next, a solvent wherein resin for fixation, coloring agent, polyisocyanate a material for forming the shells, and other necessary additives are dissolved or dispersed is emulsified in an aqueous medium and stirred at a high velocity so as to make the oil drops reduced to a desired size evenly by preventing the fine particles from coagulating.

The sizes of the oil drops are adjusted to 3–20 μm in terms of number average particle sizes, preferably 5–17 μm and more preferably 8–15 μm. If the size is more than 20 μm, chargeability of the capsule toner deteriorates. If the size is less than 3 μm, the capsule toner is so small in particle size that the fluidity of the toner deteriorates and the capsule toner tends to coagulate. The size of the oil drops can be adjusted by mechanical stirring by means of a mixer etc.

An oil drop thus obtained contains therein resin for fixation in the state of solution or dispersion, formed by radical polymerization. The oil drop contains colorant or magnetic powder in larger quantities at the outward portion than inside, and such a drop is dispersed in water.

It is desirable to add a dispersion stabilizer in said dispersion liquid in order to prevent fine particles from coagulating. By so doing it becomes possible to produce capsule toner particles of even size. Dispersion stabilizers suitable for the use are gelatin, polyvinyl alcohol, gum arabic, hydroxy methylcellulose, hydroxy ethylcellulose, hydroxy propylcellulose, sodium polyacrylate, anionic surface-active agent, nonionic surface-active agent, cationic surface-active agent, colloidal silica, colloidal alumina, tricalcium phosphate, ferric hydrate, aluminum hydroxide, etc.

Said dispersion liquid is prepared at a temperature in the range 0°–15° C., preferably in the range 5°–10° C. If the temperature is higher than 15° C., the dispersion liquid tends to react with water.

Next, to the dispersion liquid thus obtained water-soluble polyamines such as ethylene diamine or polyol, each singly or in the form of water solution of the mixture of the two, may be added in such a manner as to cause the isocyanate group to react with amine or hydroxyl group at the interface between said oil drop and water. The reaction forms membrane of polyurethane, that of polyurea, or a compound membrane of the two polymers, which encapsulates the oil drop, thus producing a capsule toner according to the invention.

In cases a polyol is added when the oil drops are formed, the polyol reacts with isocyanate in the oil drops (in situ polymerization) to form an urethane polymer. This urethane polymer ties the colorant or the magnetic powder firmly together, strengthens the polymer structure, and contributes to forming the toner shells.

The shell membrane must have a thickness in the range of 0.01–0.8 μm, preferably in the range of 0.1–0.4 μm. If the thickness is more than 0.8 μm, the shell assumes an excessive strength and is not easy to break when pressure is applied for fixation. If the thickness is less than 0.01 μm, the shell becomes fragile and easily breaks when handled.

Polyamines useful as additives at the interfacial polymerization may be ethylene diamine, trimethylene diamine, tetramethylene diamine, pentamethylene diamine, hexamethylene diamine, p-phenylene diamine, m-phenylene diamine, piperazine, 2-methyl piperazine, 2,5-dimethyl piperazine, 2-hydroxy trimethylene diamine, diethylene triamine, triethylene tetramine, diethyl amino propylamine, tetraethylene pentamine, amino-added product of epoxy compound etc.

Polyols applicable as additives at the interfacial polymerization are the same as those specified in the foregoing description.

The interfacial polymerization is carried out at a temperature in the range 10°–60° C., preferably in the range 15°–50° C. If it is higher than 60° C., the solvent vaporizes and leaves fine holes in the surface of the shell. If it is lower than 10° C., the reaction takes place slowly and is prolonged.

5–8 hours are sufficient for the interfacial polymerization, although the time depends on the polymerization temperature.

The capsule toner is collected through drying after separation from the liquid medium.

The method (b) for producing a capsule toner according to the invention is carried out as follows:

First, the monomer to form a resin for fixation, colorant, isocyanate to form the shell, and additives according to the method (a), where necessary, are dissolved or dispersed in a solvent, which then is emulsified in water or in water solution of emulsifiers, where necessary by stirring at a high velocity so as to adjust the oil drop of the dispersion therein to a uniform desired size and to prevent fine particles therein from coagulating. Simultaneously, a reaction takes place between isocyanate group and an amine or hydroxyl group, whereby resin membrane of polyurethane or polyurea or their compound membrane is formed at the interface between the oil drop and water so that shells for a capsule toner are thereby formed according to the method (a) already described. In parallel or subsequence with this formation of shells to encapsulate oil drops, the resin for fixation is formed by in-situ polymerization so as to produce a capsule toner.

The method (c) for the production of a capsule toner according to the present invention is to use for the fixation a resin which has preliminarily been polymerized, whether by preparing it from a monomer according to the method (a) or by using a thermoplastic resin generally used for toners of the heat fixation type, such as polyester resin, epoxy resin or polyamide resin. The method (c) is more or less the same as the method (a).

A capsule toner according to the invention can be used both as one component type developer and two component type developer. This capsule toner is capable of being heat fixed at low temperatures, besides being fixable by pressure. Heat fixation at low temperatures can be practiced by lowering Tg of the resin for fixation, the softening point, from the ordinary level of the resins of the heat fixation type.

A capsule toner transferred onto a transfer sheet and adhearing thereto is broken by pressure applied by a fixation roller. When it is broken, the organic solvent vaporizes or penetrates into the transfer sheet, whereas the resin for fixation is fixed to the sheet and solidifies. The colorant wrapped in the resin produces a picture image in thick black.

The fixation does not necessary require heating. But heating quickens the vaporization of the solvent, and ensures good fixation.

The present invention will be described further in detail with reference to examples. The phrase "part by weight" will be shortened to "part(s)" in the examples which follow.

EXAMPLE 1

Manufacture of Microcapsule Toner

Capsule Toner 1

A black magnetic ink was prepared by mixing 50 grams of EPT-1000 (magnetite, made by Toda Kogyo K.K.) with a solution of 70 grams of styrene, 30 grams of n-butyl methacrylate and 1 gram of Catalyst V-65 (2,2'-azobis(2,4-dimethyl valeronitrile), made by Wako Jyunyaku Kogyo K.K.) in 200 grams of a mixture solvent of ethyl acetate and acetone (3:1) and by kneading the mixture obtained in a planetary mill for one hour. Then 50 grams of Isopar H (aliphatic hydrocarbon, made by Esso Standard Corp.) was added to said magnetic ink and evenly dispersed therein. Next, to the mixture obtained was added under cooling a solution of 10 grams of Takenate D-102 (made by Takeda Yakuhin Kogyo K.K.) in 10 grams of ethyl acetate and the mixture was mixed well to produce a black ink isocyanate solution.

On the other hand, one liter of a water solution of 3% gum arabic (made by Wako Jyunyaku Kogyo K.K.) and 1% polyvinyl alcohol (made by Wako Jyunyaku Kogyo K.K.) was prepared and cooled well in iced water. Then into this water solution said black ink—isocyanate solution was put, stirred for 30 minutes by rotation of an automatic homogenizing mixer at 6,000 rpm, and finely divided so that the oil drops assumed an average size of 12.3 μm.

Next, by adding 20 grams of a water solution of 10% hexamethylenediamine (made by Wako Jyunyaku K.K.) dropwise said black ink—isocyanate solution was allowed to react over the period of 10 minutes, and then gradually warmed up with stirring at 2,000 rpm for two hours, and while the temperature was held at 80°-90° C., the stirring was continued for another six hours.

After the reaction, unreacted substances, gum arabic, and the like as well as excessively fine particles were removed from the black ink—isocyanate solution by decantation and rinsing in pure water repeated in three steps, and then the capsule toner was separated from the liquid by means of a centrifuge. Said capsule toner was dried by heating at 60° C. for 48 hours, and subsequently by classifying the number average particle size was determined at 10.2 μm, the particles of smaller than 3 μm were at 1.2% and those of larger than 20 μm at 0.8%. The surfaces of this capsule toner were treated with 0.2% hydrophobic silica R-972 (made by NiPPon Aerosil K.K.). The capsule toner thus obtained was designated as capsule toner 1.

Figure 3:
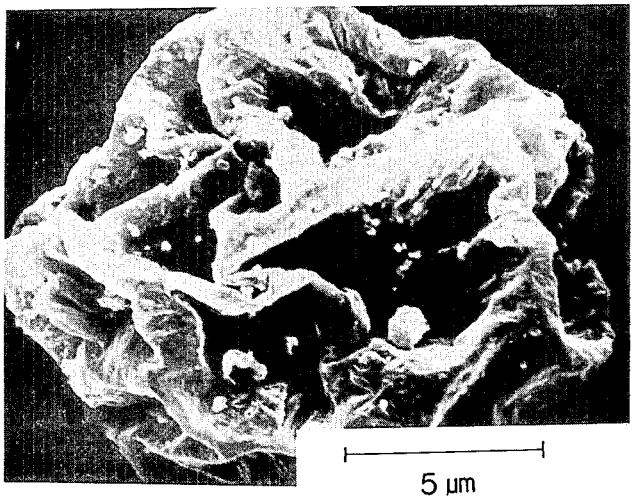
FIG. 3 is an electron micrography of one embodiment of the capsule toner of the present invention.
Figure 4:
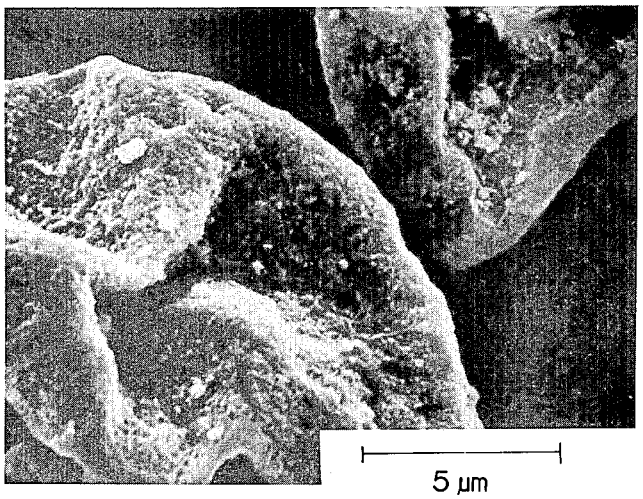
FIG. 4 is an electron micrograph of the same capsule toner of FIG. 3, but more magnified.

FIG. 3 and FIG. 4 show the surface structure of a particle of capsule toner 1 as observed by SEM (FIG. 4 is a magnified one of FIG. 3).

Capsule toner 1 had many wrinkles, the surface being rugged with dents.

The shape factor (SF1) was 135.

CAPSULE TONER 2

The same composition and manufacturing method as for capsule toner 1 were followed. After drying, the capsule toner produced was classified by means of the same equipment as for capsule toner 1 but under a different condition, and the number average particle size in the particle distribution was determined at 5.6 μm, the particles of smaller than 3 μm were at 7.6% and those of larger than 20 μm at 0.1%. The surfaces of this capsule toner were treated with 0.2% hydrophobic silica R-972 (made by Nippon Aerosil K.K.). The capsule toner thus obtained was designated as capsule toner 2.

A particle of capsule toner 2 was similar to that of capsule toner 1 shown in FIG. 3, having many wrinkle or a rugged surface, according to SEM observation.

CAPSULE TONER 3

A black ink was prepared by mixing 60 grams of $CuFe_2O_4$ - $CuMn_2O_4$ (made by Dainichi Seika K.K.) with a solution of 40 grams of styrene (first grade reagent, made by Wako Jyunyaku Kogyo K.K.), 60 grams of 2-ethylhexylmethacrylate (first grade reagent, made by Wako Jyunyaku Kogyo K.K.) and 2 grams of azobisisobutyronitrile (first grade reagent, made by Wako Jyunyaku Kogyo K.K.) in 200 grams of a mixture solvent of dichloromethane and acetone (3:1) and by mixing the dispersion well by means of a vibration mill.

$CuFe_2O_4$ - $CuMn_2O_4$

The particle size distribution determined by the light transmission type instrument for measuring particle size distribution ranges 0.05–1 μm with the average size between approximately 0.1–0.2 μm. The oil absorptivity is 35 cc/100 g.)

Then, to 150 grams of a black ink thus obtained was added under cooling a solution of 10 grams of Takenate D-102 (isocyanate, made by Takeda Yakuhin Kogyo K.K.) in 5 grams of ethyl acetate and the mixture was mixed well to produce a black ink—isocyanate solution.

On the other hand, a water solution of 5% gum arabic (made by Wako Jyunyaku Kogyo K.K.) was prepared and cooled well in iced water. Then into this water solution said black ink—isocyanate solution was put and stirred for 30 minutes by rotation of an automatic homogenizing mixer at 6,000 rpm, and finely divided as a result.

Next, said black ink—isocyanate solution, while 25 grams of 10% hexamethylenediamine (made by Wako Jyunyaku Kogyo K.K.) was added dropwise thereto, was stirred for 10 minutes, and then gradually warmed up with stirring at 2,500 rpm for two hours, and while the temperature was held at 80°-90° C., the stirring was continued for another six hours before a reaction was over.

After the reaction, unreacted substanced, gum arabic, and the like as well as excessively fine particles were removed from the black ink—isocyanate solution by decantation and rinsing in pure water repeated in three steps, and then this liquid dispersion was dried by being atomized. Further drying by heating at 60° C. for 36 hours followed, and subsequently by classifying by the use of air there was obtained a capsule toner having a particle distribution wherein the number average particle size was determined at 5.9 μm, the particles of smaller than 3 μm were at 8.9 μm, and those of larger than 20 μm at 0%. The surfaces of this capsule toner were treated with 0.2% hydrophobic silica R-972 (made by Nippon Aerosil K.K.). The capsule toner thus obtained was designated as capsule toner 3.

A particle of capsule toner 3 was similar to that of capsule toner 1 shown in FIG. 3, having a rugged surface, according to SEM observation.

CAPSULE TONER 4

The same composition and manufacturing method as for capsule toner 3 were followed. After drying, the capsule toner produced was classified by means of the same equipment as for capsule toner 3 but under a different condition, and the number average particle size in the particle distribution was determined at 16.2 μm, the particles of smaller than 3 μm were at 0.8% and those of larger than 20 μm at 4.2%. The surfaces of this capsule toner were treated with 0.2% hydrophobic silica R-972 (made by Nippon Aerosil K.K.). The capsule toner thus obtained was designated as capsule toner 4.

A particle of capsule toner 4 was similar to that of capsule toner 1 shown in FIG. 3, having with a rugged surface, according to SEM observation.

The shape factor (SF1) was 161.

CAPSULE TONER 5

A black magnetic ink was prepared by dissolving 50 grams of EPT-1000 (magnetite, made by Toda Kogyo K.K.), 50 grams of tridecylmethacrylate, 30 grams of n-butylmethacrylate, and 1 gram of azobisisobutyronitrile as catalyst in 50 grams of a mixture solvent of dichloromethane and acetone (3:1) mixed with 80 grams of Isopar H and by mixing the compound in a ball mill for three hours.

Next, to the mixture obtained was added under cooling a solution of 15 grams of Takenate D-102 (made by Takeda Yakuhin Kogyo K.K.) in 8 grams of ethyl acetate and the mixture was mixed well to produce a black ink—isocyanate solution.

On the other hand, one liter of a water solution of 5% gum arabic (made by Wako Jyunyaku Kogyo K.K.) was prepared and cooled well in iced water. Then into this water solution said black ink—isocyanate solution was put, stirred for 30 minutes by rotation of an automatic homogenizing mixer (made by Tokushu Kikoh K.K.) at 4,000 rpm, and finely divided so that the oil drops assumed an average size of approximately 12–12.5 μm.

Next, by adding 25 grams of a water solution of 10% hexamethylenediamine (made by Wako Jyunyaku Kogyo K.K.) dropwise said black ink—isocyanate solution was allowed to react over the period of 10 minutes. After this period of time, this solution was gradually warmed up, and stirred at 2,000 rpm for two hours with its temperature maintained at 60° C. and for another six hours at 85° C. in succession before the reaction was over.

After the reaction, unreacted substances, gum arabic, and the like as well as excessively fine particles were removed from the black ink—isocyanate solution by decantation and rinsing in pure water repeated in three steps, and then this liquid dispersion was dried by being atomized. Further drying by heating at 60° C. for 36 hours followed, and subsequently by classifying by the use of air there was obtained a capsule toner with the number average particle size in the particle distribution determined at 15.3 μm, the particles of smaller than 3 μm at 0.2%, and those of larger than 20 μm at 3.20%. The surfaces of this capsule toner were treated with 0.2% hydrophobic silica R-972 (made by Nippon Aerosil K.K.). The capsule toner thus obtained was designated as capsule toner 5.

A particle of capsule toner 5 had a rugged surface, according to SEM observation.

The shape factor (SF1) was 153.

CAPSULE TONER 6

The same composition and manufacturing method as for capsule toner 1 were followed for the formation of the capsule toner. Rinsing in pure water was repeated in three steps, but decantation was not employed. Unreacted substances, gum arabic, and the like were removed by rinsing in water, but excessively fine particles remained conspicuously because of exclusion of decantation. The drying of the liquid dispersion was carried out by atomization. The atomization drying was followed by drying by heating at 60° C. for 48 hours. Subsequently, to remove coagulations from the toner, the capsule toner in process was passed through a sieve of 145 mesh, and consequently, there was obtained a capsule toner with the number average particle size determined at 9.8 μm, the particles of smaller than 3 μm at 18.8%, and those of larger than 20 μm at 3.2%. The surfaces of this capsule toner were treated with 0.2% hydrophobic silica R-972 (made by Nippon Aerosil K.K.). The capsule toner thus obtained was designated as capsule toner 6.

A particle of capsule toner 6 was similar to that shown in FIG. 3, having a rugged surface, according to SEM observation.

CAPSULE TONER 7

The same composition and manufacturing method as for capsule toner 3 were followed for the formation of the capsule toner. Rinsing in pure water was repeated in three steps, but decantation was not employed. After the rinsing, the liquid dispersion was dried by being atomized. The atomization drying was followed by drying by heating at 60° C. for 36 hours. As a result, there was obtained a capsule toner whose number average particle size was determined at 4.6 μm, and whose particles of smaller 3 μm were determined at 24.3% and those of larger than 20 μm at 0% according to classifying by means of the same equipment as in Example 3. The surfaces of this capsule toner were treated with 0.2% hydrophobic silica R-972 (made by Nippon Aerosil K.K.). The capsule toner thus obtained was designated as capsule toner 7.

A particle of capsule toner 7 was similar to that shown in FIG. 3, having a rugged surface, according to SEM observation.

CAPSULE TONER 8

The same composition and manufacturing method as for capsule toner 7 were followed for the formation of the capsule toner. However, the capsule toner obtained was classified under a different condition, and the number average particle size in the particle distribution was determined at 18.2 μm, the particles of smaller than 3 μm were at 0.2% and those of larger than 20 μm at 16.3%. The surfaces of this capsule toner were treated with 0.2% hydrophobic silica R-972 (made by Nippon Aerosil K.K.). The capsule toner thus obtained was designated as capsule toner 8.

A particle of capsule toner 8 was similar to that shown in FIG. 3, having a rugged surface, according to SEM observation.

CAPSULE TONER 9

The same composition and manufacturing method as for capsule toner 5 were followed for the formation of the capsule toner. The capsule toner obtained after drying was classified by means of the same equipment but under a different condition, and the number average particle size in the particle distribution was determined at 16.4 μm, the particles of smaller than 3 μm were at 0.1% and those of larger than 20 μm at 8.8%. The surfaces of this capsule toner were treated with 0.2% hydrophobic silica R-972 (made by Nippon Aerosil K.K.). The capsule toner thus obtained was designated as capsule toner 9.

A particle of capsule toner 9 had a rugged surface, according to SEM observation.

CAPSULE TONER 10

A black magnetic ink was prepared by dissolving 50 grams of EPT-1000 (magnetite, made by Toda Kogyo K.K.), 80 grams of n-butylmethacrylate, and 1 gram of Catalyst V-65 (2,2'-azobis(2,4-dimethyl valeronitrile), made by Wako Jyunyaku Kogyo K.K.) in 50 grams of of acetone mixed with 80 grams of Isopar H and by mixing the compound in a ball mill for three hours.

Next, to the mixture obtained was added under cooling a solution of 15 grams of Takenate D-102 (made by Takeda Yakuhin Kogyo K.K.) in 8 grams of ethyl acetate and the mixture was mixed well to produce a black ink—isocyanate solution.

On the other hand, one liter of a water solution of 5% gum arabic (made by Wako Jyunyaku Kogyo K.K.) was prepared and cooled well in iced water. Then into this water solution said black ink—isocyanate solution was put, stirred for 30 minutes by rotation of an automatic homogenizing mixer (made by Tokushu Kikoh K.K.) at 4,000 rpm, and finely divided so that the oil drops assumed an average size of approximately 10–10.5 μm.

Next, by adding 25 grams of a water solution of 10% hexamethylenediamine (made by Wako Jyunyaku Kogyo K.K.) dropwise said black ink—isocyanate solution was allowed to react over the period of 10 minutes. After this period of time, this solution was gradually warmed up, and stirred at 2,000 rpm for two hours with its temperature maintained at 60° C. and for another six hours at 85° C. in succession before the reaction was over.

The reaction was followed by rinsing in pure water. After removal of unreacted substances, gum arabic, and the like by the rinsing and subsequent drying, the capsule toner obtained was classified and its number average particle size was determined at 15.1 μm, the particles of smaller than 3 μm were at 0.3% and those of larger than 20 μm at 3.5%. The surfaces of this capsule toner were treated with 0.2% hydrophobic silica R-972 (made by Nippon Aerosil K.K.). The capsule toner thus obtained was designated as capsule toner 10.

Figure 5:
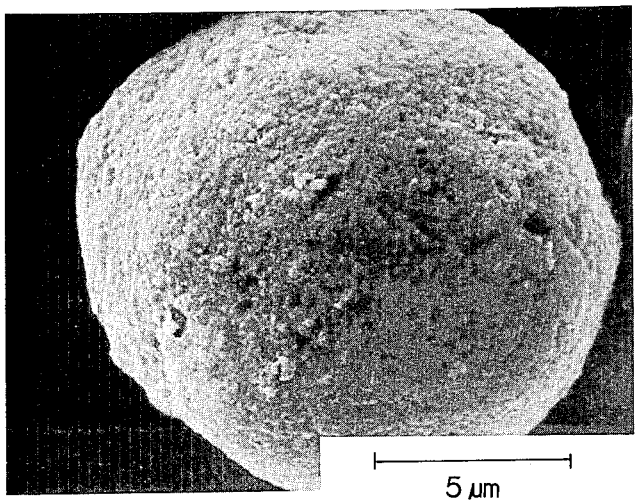
FIG. 5 is an electron micrograph of a conventional capsule toner used for the comparison.

FIG. 5 illustrates the surface of a particle of capsule toner 10 as SEM observed. The particle was globular with no ruggedness at its surface.

The shape factor (SF1) was 110.

CAPSULE TONER 11

The same composition and manufacturing method as for capsule toner 10 were followed for the formation of the capsule toner. By classifying under a different condition the capsule toner obtained had a particle distribution wherein the number average particle size was determined at 19.5 μm, the particles of smaller than 3 μm were at 0.1% and those of larger than 20 μm at 19.3%. The surfaces of this capsule toner were treated with 0.2% hydrophobic silica R-972 (made by Nihon Aerosil K.K.). The capsule toner thus obtained was designated as capsule toner 11.

A particle of capsule toner 11 was globular with no ruggedness at its surface, according to SEM observation.

CAPSULE TONER 12

Into 1 liter of a water solution of 5% gum arabic was put under cooling a mixture of 70 grams of styrene, 30 grams of n-butylmethacrylate, 2 grams of azobis isobutyronitrile, 5 grams of nigrosine base EX (nigrosine type oil-soluble dye, made by Orient Kagaku Kogyo K.K.), and 7 grams of carbon black (R-400R, made by Cabbot Co.) and stirred in a homogenizing mixer rotated at a high speed of 7,000 rpm so that the compound was made into a suspension of fine particles. Then suspension polymerization was made to take place at 60° C. for three hours and at 90° C. for another three hours.

The reaction was followed by removal of unreacted substances, gum arabic, and the like as well as excessively fine particles by decantation and rinsing in pure water repeated in three steps, and the liquid dispersion was dried by being atomized. Further drying by heating at 60° C. for 36 hours followed, and subsequently by classifying by the use of air there was obtained a capsule toner with the number average particle size determined at 5.9 μm, the particles of smaller than 3 μm at 8.9 μm, and those of larger than 20 μm at 0%. The surfaces of this capsule toner were treated with 0.2% hydrophobic silica R-972 (made by Nippon Aerosil K.K.). The capsule toner thus obtained was designated as capsule toner 12.

Figure 8:
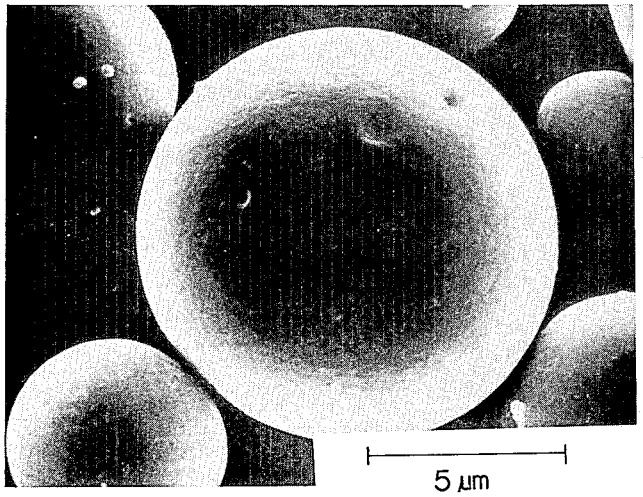
FIG. 8 is an electron micrograph of a conventional capsule toner used for the comparison.

A particle of capsule toner 12 was almost a true globe in shape, having no ruggedness at its surface, according to SEM observation, which was shown by FIG. 8.

The shape factor (SF1) was 105.

CAPSULE TONER 13

The same composition and manufacturing method as for capsule toner 12 were followed for the formation of the capsule toner. After formation of particles, the liquid dispersion was filtered by means of a centrifugal filtration apparatus. While unreacted substances, gum arabic, and the like were removed by rinsing in water repeated sufficiently, care was taken not to allow fine particles of toner to run off. The filtrate was dispersed again in a solution of water and an alcohol and this liquid dispersion was dried by being atomized. Further drying by heating at 60° C. for 36 hours followed, and subsequently by classifying by the use of air there was obtained a capsule toner having a particle distribution wherein the number average particle size was determined at 5.2 μm, the particles of smaller than 3 μm were at 13.8% and those of larger than 20 μm at 0%. The surfaces of this capsule toner were treated with 0.2% hydrophobic silica R-972 (made by Nippon Aerosil K.K.). The capsule toner thus obtained was designated as capsule toner 13.

A particle of capsule toner 13 was almost a true globe in shape, having no ruggedness at its surface, according to SEM observation.

Manufacture of Binder Type Carrier (A)

| Ingredients | parts |
|---|---|
| magnetic powder (EPT-1000, made by Toda Kogyo K.K.) | 500 |
| bisphenol A type polyester resin (softening point 123° C., glass transition point 65 C, AV;21, OHV;43, Mn;7600, Mw;188400) | 100 |
| carbon black (MA #8, made by Mitsubishi Kasei Kogyo K.K.) | 2 |

Carrier A with an average particle size of 60 μm was obtained through a procedure wherein the above-mentioned ingredients were mixed well in a super mixer, kneaded by a biaxial exclusion kneader, cooled, coarsely pulverized, pulverized to an average particle size of 70 μm in a hammer mill, and classified into coarse powder and fine powder by the use of air.

Preparation of Developers

Each of the magnetic toners (capsule toner 1, 2, 5, 6, 9, 10, 11) was used in a proportion of 40 wt. % in combining with binder type carrier (A) to produce a developer.

Each of the non-magnetic toners (capsule toner 3, 4, 7, 8, 12, 13) was used in a proportion of 10 wt. % in combining with binder type carrier (A) to produce a developer.

The apparatuses used for the imaging and the running test in the evaluations (1) through (7) below were adapted as follows: for the tests of the developers based on the magnetic capsule toners (capsule toner 1, 2, 5, 6, 9, 10, 11), the photosensitive member in PPC EP-350Z (made by Minolta Camera K.K.), which was equipped with a developing device of the system of both sleeve and magnetic roller rotating, was replaced with a photosensitive member for EP-360Z, and also a fixation device of the variable pressure type was introduced therefor, whereas for the tests of the developers based on the non-magnetic capsule toners (capsule toner 3, 4, 7, 8, 12, 13), the fixation device for PPC EP-360Z (made by Minolta Camera K.K.), which was equipped with a developing device of the sleeve rotating system, was replaced with a fixation device of the variable pressure type.

Furthermore, the magnetic capsule toners designated as capsule toner 1, capsule toner 3 and capsule toner 4 were used each singly as one component developer in conjunction with PPC EP-450Z (made by Minolta Camera K.K.) after replacing its fixation device with one of the variable pressure type for the imaging and the running test in the same evaluations.

Methods of Evaluation of Toner Properties (1) Particle Size Distribution of Toner With respect to particle sizes of toners the number distribution by particle sizes was measured by means of Coulter counter of the II type (made by Coulter Counter Inc.), and aperture tubes of 50 μm and 100 μm where convenient.

(2) Capacity for Charging

Each of the developers prepared according to the foregoing prescription was put in a 1 liter polyethylene bottle, stirred at 120 rpm for 3 hours, and then the amount of electrification of each was measured.

(3) Initial Image Density

Each developer, after stirring according to the above description, was put to imaging by said copying machines and the image density was measured by a Sakura reflection density meter (made by Konishiroku Shashin Kogyo K.K.).

(4) Fogging

Liability to fogging was rated by evaluating the image quality after 10,000 sheet were printed in printing resistance test, as follows:

A: No fogging occurred.

B: The fogging involves no problem in the practice.

C: Fogging is clearly observed but tolerable in the practice.

D: Fogging occurs conspicuously and beyond tolerance in the practice.

Pressure Fixation Property

The fixability by pressure is influenced by coarseness of the surface of copying paper as well as the degree of pressure. The rating, therefore, was done for pressures of 100 kg/cm$^2$ and 300 kg/cm$^2$ and for three kinds of paper—coarse paper (Beck smoothness 10 sec), ordinary paper (Beck smoothness 30 sec) and quality paper (Beck smoothness 1,000 sec).

The values of Beck smoothness were determined by the method prescribed under P8119 in Japan Industrial Standard.

The rating was based on removability when adhesive tape was applied, as follows:

A: The toner does not come off.

B: The toner slightly comes off in part but no problem is involved in the practice.

C: Part of the letters come off.

D: The toner mostly comes off and is not suited to practice.

(6) Cleaning property

A: No problem occurred in printing up to 5,000 sheets.

B: Black streaks occurred at several points on the photosensitive member in printing up to 5,000 sheets, though these effects were slight.

C: Black streaks occurred around the photosensitive member in printing up to 1,000 sheets.

(7) Filming resistance

A: No disorder occurred in printing up to 5,000 sheets.

B: Filming occurred on the photosensitive member in printing up to 5,000 sheets, causing the image densities to lower or resulting in fogging.

C: Filming occurred on the photosensitive member in printing up to 1,000 sheets, causing the image densities to lower or resulting in fogging.

Table 1 shows the results of the evaluations.

Charging Stability

The rising characteristic in charging was evaluated with respect to developers based on capsule toners 5 and 10 combined with binder type carrier (A), used in Examples 5 and Comparison 5.

Figure 7:
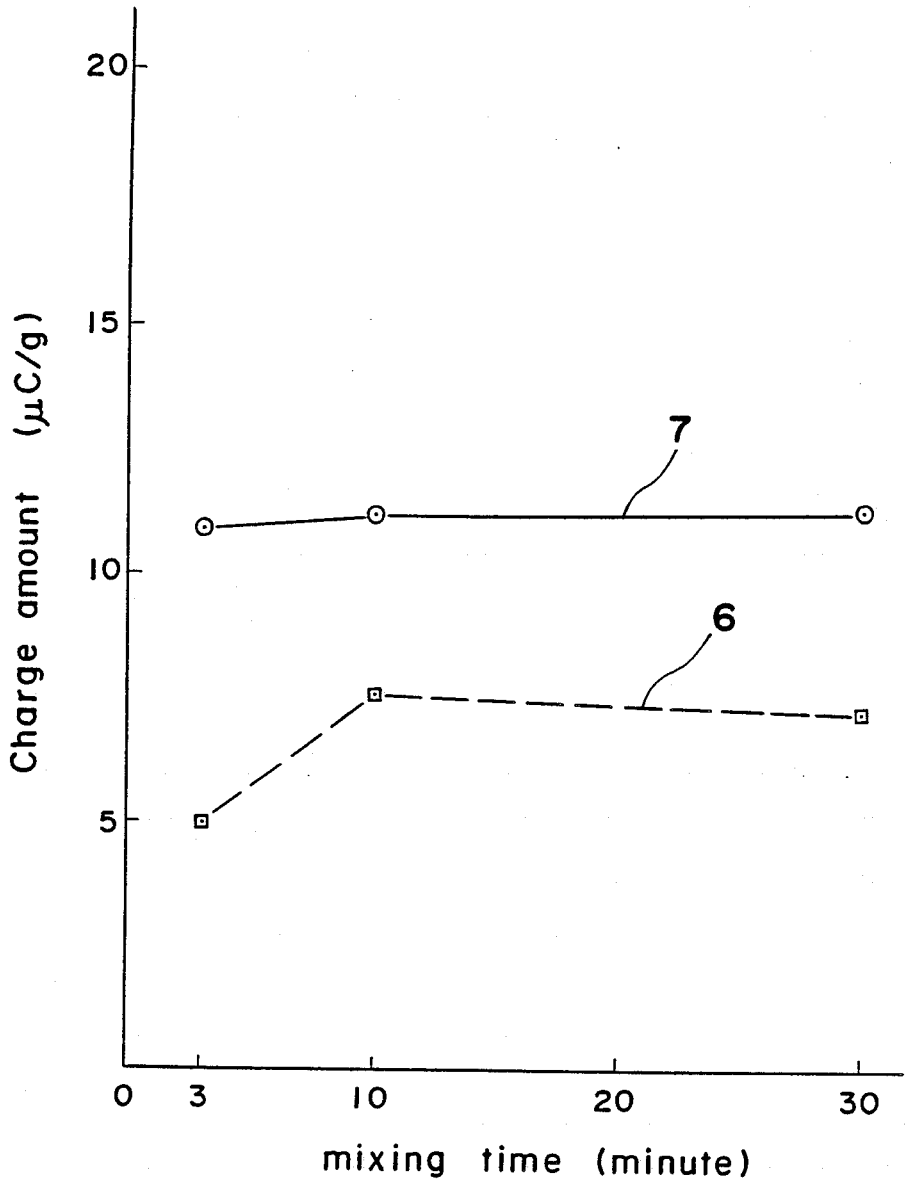
FIG. 7 shows the changes of the electrification degrees of toner respecting the developing agents based on the toner of the invention and that in the comparison.

Each developer was put in a polyethylene bottle of 50 cc capacity and the bottle was rotated at 120 rpm. The amount of electrification of the toner was measure after 3 minutes, after 10 minutes, and after 30 minutes by taking out part of the developer. FIG. 7 shows the results.

As shown in FIG. 7, the toner provided by the present invention (plot 7), compared with the toner in Comparison 5 (plot 6), showed a sharp rising characteristic and satisfactory amount of electrification.

TABLE 1

| Example and Comparison | toner | particle size of toner (number by particle size) number average diameter (μm) | <3 μm (%) | >20 μm (%) | proportion of toner in developer (%) | charge amount (μC/g) | initial image density | rank of fog |
|---|---|---|---|---|---|---|---|---|
| Example | | | | | | | | |
| 1 | 1 | 10.2 | 1.2 | 0.8 | 40 | 12 | 1.3 | A |
| 2 | 2 | 5.6 | 7.6 | 0.1 | 40 | 14 | 1.1 | A |
| 3 | 3 | 5.9 | 8.9 | 0 | 10 | 14 | 1.1 | A |
| 4 | 4 | 16.2 | 0.8 | 4.2 | 10 | 11 | 1.3 | A |
| 5 | 5 | 15.3 | 0.2 | 3.2 | 40 | 11 | 1.3 | A |
| 6 | 1 | 10.2 | 1.2 | 0.8 | 100 | 11 | 1.3 | A |
| 7 | 5 | 15.3 | 0.2 | 3.2 | 100 | 12 | 1.3 | A |
| Comparison | | | | | | | | |
| 1 | 6 | 9.8 | 18.8 | 3.2 | 40 | 14 | 0.8 | D |
| 2 | 7 | 4.6 | 24.3 | 0 | 10 | 16 | 0.7 | D |
| 3 | 8 | 18.2 | 0.2 | 16.3 | 10 | 7 | 1.2 | B |
| 4 | 9 | 16.4 | 0.1 | 8.8 | 40 | 9 | 1.2 | B |
| 5 | 10 | 15.1 | 0.3 | 3.5 | 40 | 7 | 0.9 | D |
| 6 | 11 | 19.5 | 0.1 | 19.3 | 40 | 5 | 0.7 | D |
| 7 | 12 | 5.9 | 8.9 | 0 | 10 | 8 | 1.0* | D |
| 8 | 13 | 5.2 | 13.8 | 0 | 10 | 7 | 0.9* | D |
| 9 | 10 | 15.1 | 0.3 | 3.5 | 100 | 4 | 0.7 | D |

| Example and Comparison | fixability by pressure 100 kg/cm² coarse | ordinary | quality | 300 kg/cm² coarse | ordinary | quality | cleaning property | filming resistance |
|---|---|---|---|---|---|---|---|---|
| Example | | | | | | | | |
| 1 | B | A | A | B | A | A | A | A |
| 2 | B | A | A | B | A | A | A | A |
| 3 | B | A | A | B | A | A | A | A |
| 4 | A | A | A | A | A | A | A | A |
| 5 | B | A | A | A | A | A | A | A |
| 6 | B | A | A | B | A | A | A | A |
| 7 | B | A | A | A | A | A | A | A |
| Comparison | | | | | | | | |
| 1 | D | D | C | D | C | C | C | A |
| 2 | D | D | D | D | D | C | C | A |
| 3 | A | A | A | A | A | A | A | C |
| 4 | A | A | A | A | A | A | A | C |
| 5 | C | B | A | B | A | A | C | C |
| 6 | B | A | A | B | A | A | C | C |
| 7 | D | D | C | D | D | C | C | C |
| 8 | D | D | D | D | D | D | C | C |
| 9 | C | B | A | B | A | A | C | C |

*there is much scattering.

What is claimed is:

1. A capsule toner which comprises a shell of a chargeable resin and a filling therein, said filling containing at least a high boiling point solvent, a resin for fixation dissolved or dispersed in said solvent, and a colorant, wherein the shape of said toner is irregular and has a wrinkled surface as substantially depicted in FIG. 3, and the number average particle sizes range from 5 to 17 μm in the distribution of the particles, the particles with sizes if less than 3 μm having a proportion of less than 10% in number and those with sizes of more than 20 μm having a proportion of less than 5% in number.

2. A capsule toner of claim 1, in which the shell is made from isocyanates and polyols of polyamines.

3. A capsule toner of claim 1, in which the shell has a thickness of from 0.01 to 0.8 micron meter.

4. A capsule toner of claim 1, in which the solvent is aliphatic hydrocarbons which may have a branch and/or organic polysiloxane.

5. A capsule toner of claim 1, in which the solvent has a boiling point of from 150° to 350° C.

6. A capsule toner of claim 1, in which the filling contains a solvent having a lower boiling point in addition to the solvent having a high boiling point.

7. A capsule toner of claim 1, in which the resin for fixation is derived from the polymerization of one or more of monomers selected from the group consisting of acrylic acid esters, methacrylic acid esters, styrenes, and vinyl monomers.

8. A capsule toner of claim 1, in which said capsule toner is formed by a process comprising a step of mixing at least a high boiling point solvent, a first shell forming monomer, a fixing monomer, a polymerization initiator and a colorant to make a dispersion; a step of emulsifying the dispersion into fine oil drops in an aqueous medium containing a second shell forming monomer; and a step of forming the shell around the oil drops by means of interfacial polymerizzation between said first and second shell forming monomers and simultaneously or subsequently polymerizing the fixing monomer in the dispersion by means of in-situ polymerization.

9. A capsule toner of claim 1, in which the shape factor (SF1) represented by the formula:

$$SF1 = \frac{(\text{maximum length})^2}{\text{area}} \times \frac{\pi}{4} \times 100$$

(wherein the maximum length is the largest distance between any two points on the periphery in the projection chart of a particle, and the area represents the area of the projection of a particle).

10. A capsule toner of claim 1, in which the ratio of the monomer for producing a resin for fixation to the solvent is 1–1000 parts by weight to 100 parts by weight.

11. A capsule toner of claim 1, in which the dispersion particle in the emulsion is adjusted to 3–20 micron meter in terms of number average particle sizes.

12. A capsule toner of claim 1, in which the interfacial polymerization is carried out at 10°–60° C., and the in-situ polymerization at a temperature of from 50°–90° C.

* * * * *